US006201473B1

(12) United States Patent
Schaffer

(10) Patent No.: US 6,201,473 B1
(45) Date of Patent: Mar. 13, 2001

(54) SURVEILLANCE SYSTEM FOR OBSERVING SHOPPING CARTS

(75) Inventor: Joel M. Schaffer, Boca Raton, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 0 days.

(21) Appl. No.: 09/298,645

(22) Filed: Apr. 23, 1999

(51) Int. Cl.[7] ..... G08B 13/14

(52) U.S. Cl. ..... 340/568.5; 340/568.1; 340/568

(58) Field of Search ..... 340/568, 568.1, 340/568.5, 556, 555, 674, 600, 666, 572.1, 572.3, 572.2

(56) References Cited

U.S. PATENT DOCUMENTS

| | | | | |
|---|---|---|---|---|
| 3,828,125 | * | 8/1974 | Fagan et al. | 178/6.8 |
| 4,327,819 | | 5/1982 | Coutta . | |
| 4,338,594 | * | 7/1982 | Holm | 340/568 |
| 4,548,295 | | 10/1985 | Lundgren . | |
| 4,723,118 | | 2/1988 | Hooley et al. . | |
| 4,725,822 | | 2/1988 | Hooley . | |
| 4,736,098 | | 4/1988 | Rehrig . | |
| 4,939,355 | * | 7/1990 | Rando et al. | 235/467 |
| 5,485,006 | * | 1/1996 | Allen et al. . | |
| 5,495,102 | | 2/1996 | Fine . | |
| 5,609,223 | * | 3/1997 | Lizaka et al. | 186/61 |
| 5,610,584 | | 3/1997 | Schrade . | |
| 5,910,769 | * | 6/1999 | Geisler | 340/568.5 |

* cited by examiner

*Primary Examiner*—Jeffery A. Hofsass
*Assistant Examiner*—Daniel Prévil
(74) *Attorney, Agent, or Firm*—Akerman Senterfitt

(57) ABSTRACT

A surveillance system for use in a checkout stand counter and the like, comprises: a camera mounted near the floor of the checkout stand counter; a monitor mounted to the checkout stand counter and positioned for convenient viewing by a cashier working at the checkout stand counter; and, constraints defining an aisle adjacent to the checkout stand counter for shopping carts moved alongside the checkout stand counter, whereby the surveillance system displays any objects on a lower tray of the shopping carts moved through the aisle. The checkout stand counter can comprise a numerical keyboard and the monitor can be positioned adjacent to the numerical keyboard, whereby the monitor is in a position giving an appearance of being associated with operation of the numerical keyboard.

19 Claims, 4 Drawing Sheets

SURVEILLANCE SYSTEM FOR OBSERVING SHOPPING CARTS

BACKGROUND OF THE INVENTION

1. Field of the Invention

This invention relates generally to surveillance systems used in the prevention of shoplifting, and in particular, to a surveillance system used to prevent shoplifting by placing items on the lower tray of a shopping cart.

2. Description of Related Art

Retail stores suffer millions of dollars of losses each year as a result of the theft of products occurring when customers intentionally or accidentally conceal items on the lower tray of their shopping carts. Retail stores are particularly vulnerable to this problem because store cashiers cannot observe the lower tray of the shopping cart from a store cashier's normal position. Although store cashiers can inspect the contents of the lower tray of a shopping cart by leaning over the checkout counter, this motion poses an inconvenience to the cashier. Furthermore, customers may consider as rude this potentially mistrustful display. Thus, retail stores having multiple cashiers and multiple checkout aisles with multiple checkout counters need a system which would allow the inspection of the lower tray of a shopping cart without needlessly inconveniencing the store cashier, or unintentionally offending the customer.

Several systems have been developed to alert a store cashier to the presence of a parcel positioned on the lower tray of a shopping cart as that cart passes through the checkout aisle. U.S. Pat. No. 4,327,819 issued to Coutta on May 4, 1982 for OBJECT DETECTION SYSTEM FOR A SHOPPING CART, U.S. Pat. No. 4,725,822 issued to Hooley on Feb. 1, 1988 for SHOPPING CART WITH LOWER TRAY SIGNALING DEVICE, and U.S. Pat. No. 4,736,098 issued to Rehrig on Apr. 5, 1988 for SIGNALING METHOD AND APPARATUS FOR A CONVENTIONAL SHOPPING CART each disclose systems whereby a combination of a light transmitter, light detector and a reflector mounted on the lower tray of a shopping cart act in concert to detect the presence of unpaid for articles on the lower tray of a shopping cart passing through a checkout aisle. Unique to the systems described in the these patents is the use of springs which bias the lower tray towards one position so that the increased weight of parcels placed on the lower tray depresses the tray, bringing the reflector into the path of the beam of light emitting from the transmitter. Still, the need for the retrofitting of the shopping carts with reflectors limits the effectiveness of this system.

The invention disclosed in U.S. Pat. No. 4,548,295 issued to Lundgren et al. on Oct. 22, 1985 for COUNTER SYSTEM illustrates one mechanical approach to the problem of unpaid-for products residing on the lower tray of a shopping cart. Lundgren et al. teaches the use of a receiving section constructed as part of the checkout counter which physically removes any articles present on the lower tray of the shopping cart as the cart passes through the disclosed system. The Lundgren system, however, is incapable of distinguishing between unpaid-for articles and non-store goods, like a purse or handbag.

Similarly, the applicants in U.S. Pat. No. 4,723,118 issued to Stillwater et al. on Feb. 2, 1988 for MAGNETIC DETECTION SYSTEM FOR ITEMS ON THE LOWER TRAY OF A SHOPPING CART employ a non-optical approach in identifying unpaid-for items on the bottom tray of a shopping cart. Stillwater et al. describe a magnetic detection system for unpaid-for items on the lower tray of a shopping cart. Like the invention revealed in the Coutta patent, the system disclosed by Stillwater et al. utilizes a spring biased lower tray. But, instead of using an optical combination of light source, light detector and light reflector, the invention disclosed in the Stillwater patent includes a magnet attached to the shopping cart lower tray, so that a change in the position of the tray resulting from items resting thereon, causes the displacement of the magnet attached to the tray and a corresponding change in the magnetic field. Nevertheless, like the preceding inventions, the system described by Stillwater et al. requires retrofitting existing shopping carts. Furthermore, the Stillwater et al. invention cannot distinguish between unpaid-for products and non-store articles.

In recent years, inventions disclosed by several patents have implemented lower tray detection systems using light transmitters and detectors positioned on either side of the checkout aisle. As a result, this type of system eliminates at least the retrofitting requirement of prior systems. In particular, U.S. Pat. No. 5,485,006 issued to Allen et al. on Jan. 16, 1996 for PRODUCT DETECTION SYSTEM FOR SHOPPING CARTS, U.S. Pat. No. 5,495,102 issued to Fine on Feb. 17, 1996 for SHOPPING CART MONITORING SYSTEM, and U.S. Pat. No. 5,610,584 issued to Schrade for DETECTION OF GOODS ON THE BOTTOM RACK OF A CART each include systems having infrared lights sources and detectors positioned across the width of a checkout aisle.

Significantly, these systems only alert the cashier to the presence of an object, not necessarily an unpaid-for product, on the lower tray of the shopping cart. None allow the cashier to visually inspect the contents of the lower tray. Although the Allen patent teaches the use of a video camera in a detection system, the Allen patent specifically limits the utility of the camera to a method for recording evidence of an object detected on the lower tray of a shopping cart. Thus, neither the camera disclosed in the Allen patent nor the inventions recited in the Fine and Schrade patents allow the cashier to personally observe and inspect the lower tray's contents.

SUMMARY OF THE INVENTION

A surveillance system as taught herein has advantages over all surveillance systems now used in the prevention of shoplifting using the lower trays of shopping carts and provides a novel and nonobvious system, including apparatus and method, for preventing shoplifting by placing items on the bottom trays of shopping carts.

A surveillance system for use in a checkout stand counter and the like, in accordance with the inventive arrangements, comprises: a camera mounted near the floor of the checkout stand counter; a monitor mounted to the checkout stand counter and positioned for viewing by a cashier working at the checkout stand counter; and, constraints defining an aisle adjacent to the checkout stand counter for shopping carts moved alongside the checkout stand counter, whereby the system displays any objects on a lower tray of the shopping carts moved through the aisle. Specifically, the camera can include a camera assembly for holding a camera; and, a camera housing for receiving the camera assembly, whereby the camera assembly can be mounted at an angle to look down the aisle without extending into the aisle. The camera held in the camera assembly can be a Class 2, low voltage small board camera.

The camera housing can comprise a single member having a plurality of camera receiving positions at different angles with respect to the aisle, whereby an optimal viewing angle of the aisle for the camera can be selected. For example, the camera assembly can be mounted in the camera housing at an angle ranging from approximately forty degrees to ninety degrees. Similarly, the camera housing can include a plurality of camera receiving members defining a plurality of camera receiving positions at different angles with respect to the aisle, whereby an optimal viewing angle of the aisle for the camera can be selected. It is an advantage of the present invention that the camera assembly can be concealed from view within the camera housing. In particular, the camera housing can have a tinted viewing lens for concealing the camera assembly.

The checkout stand counter can comprise a numerical keyboard next to which the monitor can be positioned, whereby the position of the monitor gives an appearance of being associated with the operation of the numerical keyboard. The monitor can be an LCD type monitor. Alternatively, the monitor can be a TFT type monitor having a size small enough to fit next to a cashier's keyboard.

A method to prevent shoplifting by the concealment of store items on a lower tray of a shopping cart moved through an aisle adjacent to a checkout stand counter comprises the steps of: mounting a camera to the checkout stand counter base; connecting the camera to a monitor mounted on the checkout stand counter in an inconspicuous location with respect to the aisle; and, observing in the monitor objects on lower trays of shopping carts moved though the aisle which are not otherwise observable from a working position at the checkout stand counter.

The mounting step can further include mounting the camera approximately twelve to twenty-four inches above floor level. The mounting step can also include the step of mounting the camera at an angle to look down the aisle without extending into the aisle. Finally, the mounting step can comprise mounting the camera at an angle ranging from approximately forty degrees to ninety degrees.

The connecting step can further include the step of locating the monitor adjacent to a numerical keyboard associated with the checkout stand counter, whereby the monitor is in a position giving an appearance of being associated with operating the keyboard. Likewise, the observing step can include conveniently viewing the inconspicuously located monitor.

BRIEF DESCRIPTION OF THE DRAWINGS

A presently preferred embodiment of the inventive arrangement is shown in the drawings, it being understood, however, the inventive arrangements are not limited to the precise arrangement and instrumentality shown.

DETAILED DESCRIPTION OF THE PREFERRED EMBODIMENTS

Figure 1:
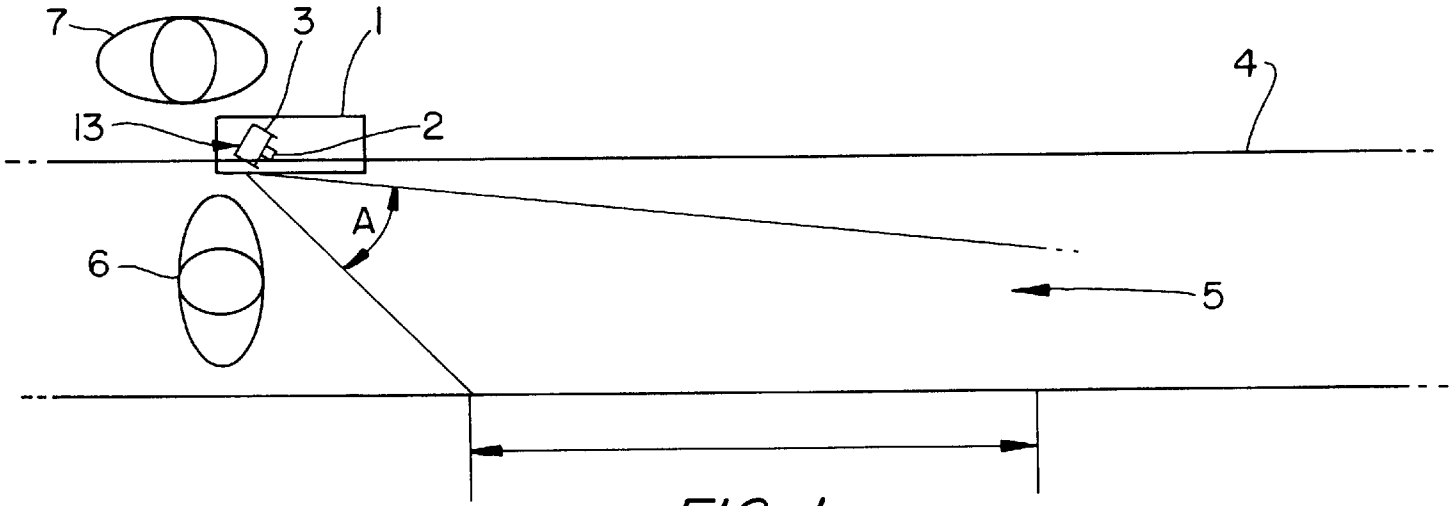
FIG. 1 is a pictorial view illustrating the preferred embodiment of the surveillance system.

FIG. 1 illustrates the preferred embodiment of the surveillance system. In the presently preferred embodiment, a camera housing 1 preferably contains a camera assembly 13. The camera assembly 13 preferably contains a small board camera mount 3 enclosing a small board camera 2. The small board camera 2, preferably having a field of view A of approximately 45 degrees to 50 degrees, preferably can be mounted near the base of the checkout stand counter 4, approximately twelve inches to twenty-four inches above the floor. The camera housing 1 preferably is mounted in the checkout stand counter 4 so that the camera housing 1 is recessed with respect to the checkout stand counter 4. The camera assembly 13 positioned within the camera housing 1 preferably is disposed at an angle to allow the small board camera 2 to view the full width of the aisle 5, up to approximately one meter wide and along the aisle 5. In consequence, camera assembly 13 advantageously can view the entire width of the aisle 5 through which the shopping cart passes as the customer 6 pays the cashier 7.

Figure 2:
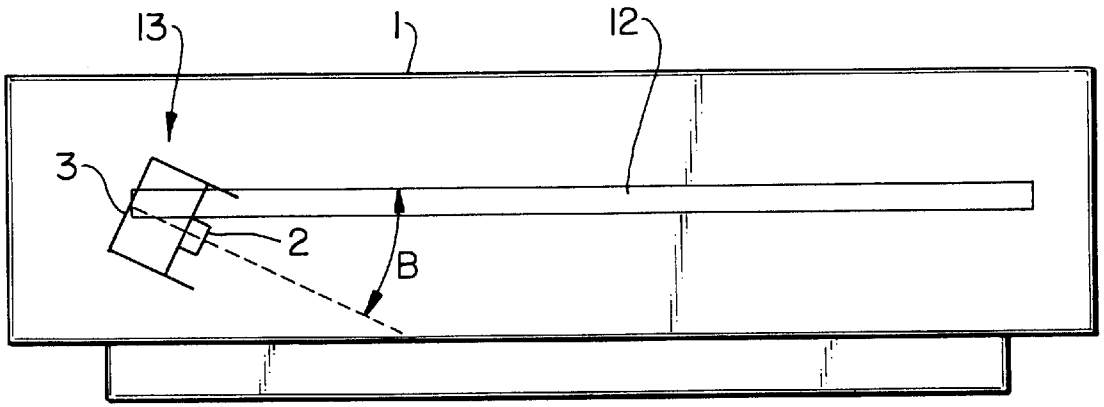
FIG. 2 is a top view of the preferred embodiment of the camera housing.

FIG. 2 depicts the camera housing 1 containing the camera assembly 13. The camera housing 1 preferably is constructed of either plastic or metal and preferably is elongated in form. For example, the camera housing 1 preferably can be approximately 304 mm long and 127 mm high. Within the camera housing 1, the camera assembly 13 preferably is mounted at an angle B ranging from approximately forty degrees to ninety degrees.

Figure 3:
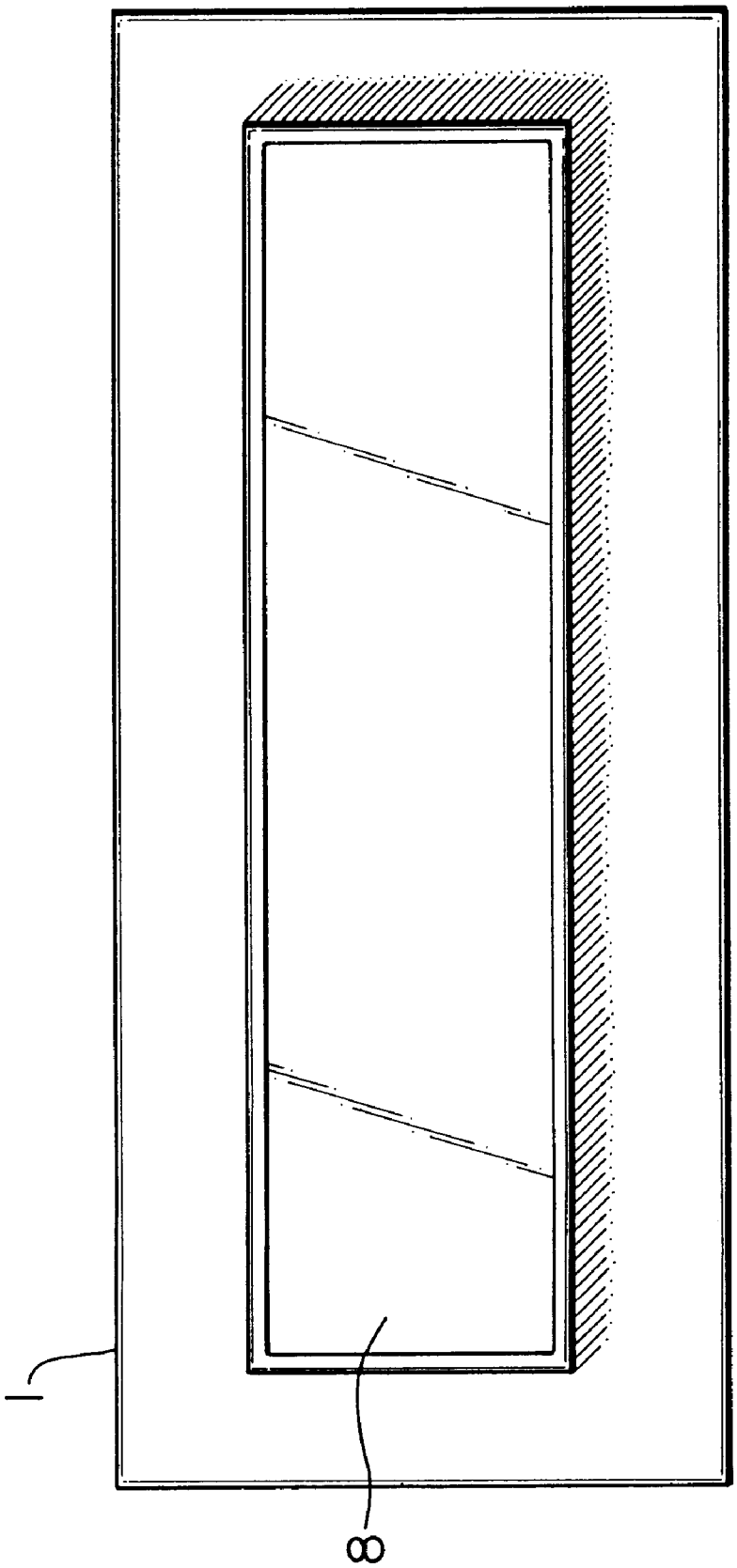
FIG. 3 is a front elevation of the preferred embodiment of the camera housing.

FIG. 3 shows the outside lens 8 of the camera housing 1. In the preferred embodiment, an impact resistant, tinted lens 8, 230 mm long in one example, preferably is embedded and centered in the elongated camera housing 1. Alternatively, the tinted lens 8 can be constructed of glass or plastic.

Figure 4:
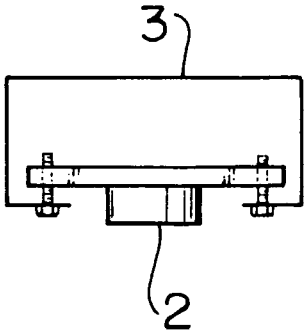
FIG. 4 is a top view of the preferred embodiment of the camera assembly.
Figure 5:
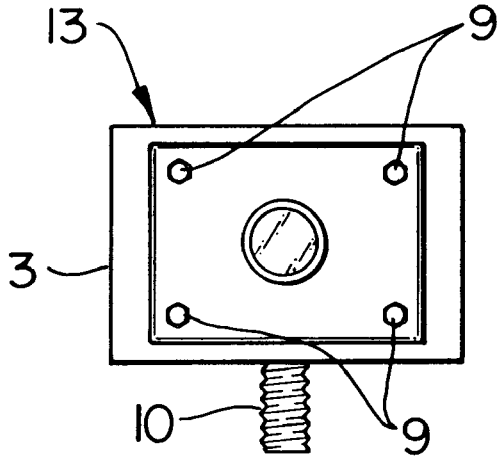
FIG. 5 is a front elevation of the preferred embodiment of the camera assembly.

FIG. 4 illustrates the top view of the camera assembly 13 in the preferred embodiment. As shown in FIG. 4, the small board camera 2 preferably is mounted to the small board camera mount 3. FIG. 5, a front elevation of the camera assembly 13, illustrates the small board camera 2 preferably mounted using four small nuts and bolts 9 having nylon washers used to dampen vibrations. A single bolt and nut 10 preferably extends from the bottom of the small board camera mount 3 for insertion into the camera housing slot 12 (as shown in FIG. 2), allowing for the selection of the best viewing angle when attaching the camera assembly 13 to the camera housing slot 12.

Figure 6:
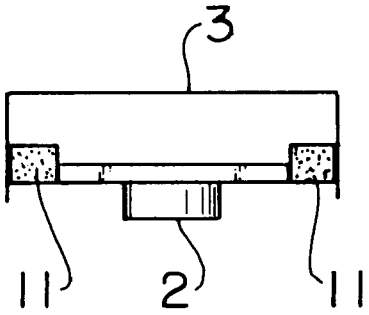
FIG. 6 is a top view of an alternate embodiment of the camera assembly.
Figure 7:
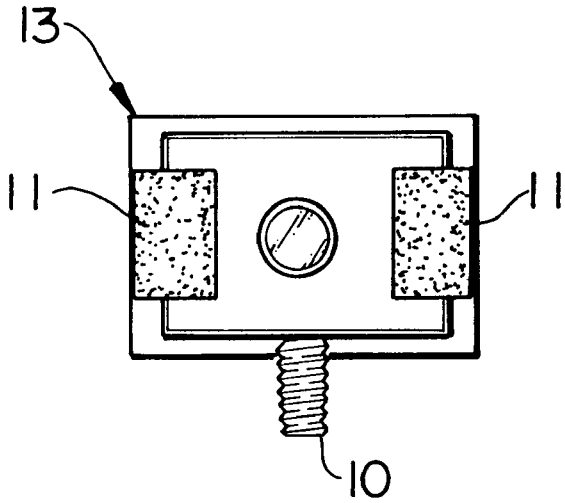
FIG. 7 is a front elevation of an alternate embodiment of the camera assembly.

FIG. 6 illustrates the top view of the camera assembly 13 in an alternative embodiment. As shown in FIG. 6, the small board camera 2 is "friction fit", or held in place by force of friction, using collapsible foam 11 on either side of the small board camera 2. FIG. 7, a front elevation of the camera assembly 13 in the alternate embodiment, shows a single bolt and nut 10 preferably extending from the bottom of the small board camera mount 3 for insertion into the camera housing slot 12 (as shown in FIG. 2).

Figure 8:
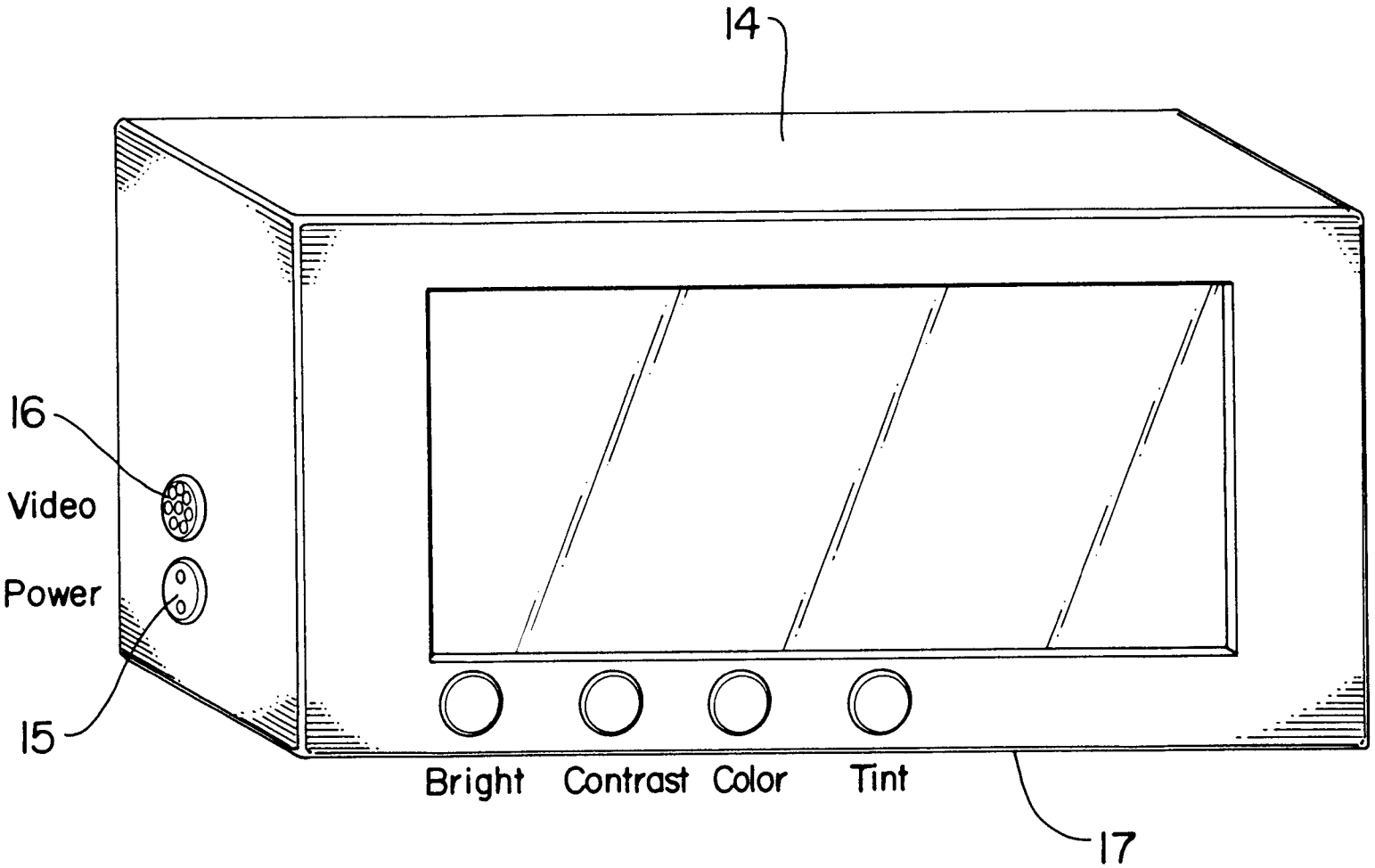
FIG. 8 is a perspective view of the preferred embodiment of the monitor.

FIG. 8 shows the monitor 14 for use in the preferred embodiment. The monitor 14 can vary in size to fit customer preference and can be of an LCD or TFT type. In the preferred embodiment, monitor 14 preferably contains a power connector 15 at the side of the monitor. Power connector 15 will normally accept a 12 Volt DC power connection. Monitor 14 preferably contains video connector 16 for connecting the monitor to the preferred embodiment. The video connector 16 preferably can be a BNC or RCA type connector and can be on the side or the bottom of the monitor 14. Bolt 17 preferably can be provided on the bottom of monitor 14 for attaching monitor 14 to a check stand counter.

What is claimed is:

1. A surveillance system for use in a checkout stand counter, the system comprising:

a camera mounted near the floor of said checkout stand counter;

a monitor mounted to said checkout stand counter and positioned for viewing by a cashier working at said checkout stand counter, said monitor positioned in an inconspicuous location with respect to an aisle adjacent to said checkout stand, said monitor positioned for viewing by a cashier;

constraints defining said aisle for shopping carts moved alongside said checkout stand counter, and, wherein said monitor displays to said cashier any objects on a lower tray of said shopping carts moved through said aisle.

2. A system according to claim 1, wherein said camera comprises:

a camera assembly for holding a camera; and, a camera housing for receiving said camera assembly, whereby said camera assembly can be mounted at an angle to look down said aisle without extending into said aisle.

3. A system according to claim 2, wherein said camera assembly is mounted in said camera housing at an angle ranging from approximately forty degrees to ninety degrees.

4. A system according to claim 2, wherein said camera housing comprises a single member having a plurality of camera receiving positions at different angles with respect to said aisle, whereby an optimal viewing angle of said aisle for said camera can be selected.

5. A system according to claim 2, wherein said camera housing comprises a plurality of camera receiving members defining a plurality of camera receiving positions at different angles with respect to said aisle, whereby an optimal viewing angle of said aisle for said camera can be selected.

6. A system according to claim 2, wherein said camera assembly is concealed from view within said camera housing.

7. A system according to claim 6, wherein said camera housing comprises a tinted viewing lens for concealing said camera assembly.

8. A system according to claim 2, wherein said camera held in said camera assembly is a Class 2, low voltage small board camera.

9. A system according to claim 1, wherein said checkout stand counter comprises a numerical keyboard and said monitor is positioned adjacent to said numerical keyboard, whereby said monitor is in a position giving an appearance of being associated with operation of said numerical keyboard.

10. A system according to claim 1, wherein said monitor is an LCD type monitor.

11. A system according to claim 1, wherein said monitor is a TFT type monitor having a size small enough to fit next to a cashier's keyboard.

12. A system according to claim 1, wherein said monitor is positioned for continuous viewing by said cashier.

13. A method to prevent shoplifting by the concealment of store items on a lower tray of a shopping cart moved through an aisle adjacent to a checkout stand counter, comprising the steps of:

mounting a camera to said checkout stand counter base;

connecting said camera to a monitor mounted on said checkout stand counter in an inconspicuous location with respect to said aisle and positioned for viewing by a cashier; and, observing in said monitor objects on lower trays of shopping carts as said carts are moved through said aisle which are not otherwise observable by said cashier from a working position at said checkout stand counter.

14. A method according to claim 13, wherein said mounting step further comprises mounting said camera approximately twelve to twenty-four inches above floor level.

15. A method according to claim 13, wherein said mounting step further comprises mounting said camera at an angle to look down said aisle without extending into said aisle.

16. A method according to claim 13, wherein said mounting step further comprises mounting said camera at an angle ranging from approximately forty degrees to ninety degrees.

17. A method according to claim 13, wherein said connecting step further comprises locating said monitor adjacent to a numerical keyboard associated with said checkout stand counter, whereby said monitor is in a position giving an appearance of being associated with operating said keyboard.

18. A method according to claim 13, wherein said observing step further comprises conveniently viewing said inconspicuously located monitor.

19. A method according to claim 13, wherein said observing in said monitor is continuous.

* * * * *